US007916040B2

(12) United States Patent
Andersen et al.

(10) Patent No.: US 7,916,040 B2
(45) Date of Patent: Mar. 29, 2011

(54) REMOTE CONTROL FOR HOME ENTERTAINMENT

(75) Inventors: Jorgen W. Andersen, Debary, FL (US); James M. Tuomy, Framingham, MA (US)

(73) Assignee: Audiovox Corporation, Hauppauge, NY (US)

( * ) Notice: Subject to any disclaimer, the term of this patent is extended or adjusted under 35 U.S.C. 154(b) by 1216 days.

(21) Appl. No.: 11/311,445

(22) Filed: Dec. 19, 2005

(65) Prior Publication Data

US 2007/0139214 A1 Jun. 21, 2007

(51) Int. Cl.
*G08C 19/00* (2006.01)

(52) U.S. Cl. ..... 340/825.69; 340/825.49; 340/825.72

(58) Field of Classification Search ..... 340/825.69, 340/825.72, 825.49, 825.22, 14.3, 825.24, 340/825.25

See application file for complete search history.

(56) References Cited

U.S. PATENT DOCUMENTS

| | | | | |
|---|---|---|---|---|
| 5,148,159 | A | 9/1992 | Clark et al. | |
| 5,282,028 | A * | 1/1994 | Johnson et al. | 725/139 |
| 5,455,570 | A | 10/1995 | Cook et al. | |
| 6,369,693 | B1 * | 4/2002 | Gibson | 340/5.8 |
| 7,064,675 | B2 * | 6/2006 | Zigmond et al. | 340/825.72 |
| 7,129,855 | B2 * | 10/2006 | Krzyzanowski et al. | 340/825.72 |
| 2002/0154024 | A1 | 10/2002 | Stevenson et al. | |
| 2005/0068222 | A1 | 3/2005 | Krzyzanowski et al. | |
| 2005/0110651 | A1 | 5/2005 | Martis et al. | |

OTHER PUBLICATIONS

International Search Report dated Aug. 5, 2009 for International Application No. PCT/US06/46717.

* cited by examiner

*Primary Examiner* — Brian A Zimmerman
*Assistant Examiner* — Nabil H Syed
(74) *Attorney, Agent, or Firm* — F. Chau & Associates, LLC

(57) ABSTRACT

A remote control system is provided that includes a master controller for storing a plurality of remote control codes for a plurality of remotely controlled equipment, receiving a remote control code request message, retrieving a requested remote control code and transmitting the requested remote control code, and a remote control unit for transmitting the remote control code request message, receiving the requested remote control code from the master controller, storing the requested remote control code, converting the remote control code into a plurality of remote control commands and transmitting at least one of the plurality of remote control commands to at least one of the plurality of remotely controlled equipment, wherein each remote control code contains the plurality of remote control commands for controlling at least one of the plurality of remotely controlled equipment.

24 Claims, 4 Drawing Sheets

REMOTE CONTROL FOR HOME ENTERTAINMENT

BACKGROUND OF THE INVENTION

1. Field of the Invention

The present invention relates generally to a remote control system and more particularly to a self-programming remote control for home entertainment.

2. Description of the Related Art

Conventional remote control units, as typically utilized in home entertainment systems, are dedicated to a particular piece of remotely controlled equipment, such as a specific make and model of television or stereo, and are permanently programmed to produce the control codes necessary to operate only the specific remotely controlled equipment with which the remote control units were provided. Universal type remote control units can be user programmed to operate many different pieces of remotely controlled equipment and some can control more than one piece of equipment at a time. Frequently, in an environment with many different pieces of remotely controlled equipment positioned in several different locations, such as in different rooms in a house, multiple remote control units are necessary even with universal type remote control units available.

SUMMARY OF THE INVENTION

An exemplary embodiment of the present invention provides a remote control system including a master controller for storing a plurality of remote control codes for a plurality of remotely controlled equipment, receiving a remote control code request message, retrieving a requested remote control code and transmitting the requested remote control code, and a remote control unit for transmitting the remote control code request message, receiving the requested remote control code from the master controller, storing the requested remote control code, converting the remote control code into a plurality of remote control commands and transmitting at least one of the plurality of remote control commands to at least one of the plurality of remotely controlled equipment, wherein each remote control code contains the plurality of remote control commands for controlling at least one of the plurality of remotely controlled equipment.

Another exemplary embodiment of the present invention provides a method of operating a remote control system including the steps of storing in a master controller a plurality of remote control codes for a plurality of remotely controlled equipment, transmitting from a remote control unit a remote control code request message, receiving the remote control code request message, retrieving in the master controller the requested remote control code, transmitting from the master controller the requested remote control code, receiving in the remote control unit the requested remote control code, converting in the remote control unit the requested remote control code into a plurality of remote control commands for controlling at least one of the plurality of remotely controlled equipment, storing in the remote control unit the plurality of remote control commands, and transmitting at least one of the plurality of remote control commands to control at least one of the plurality of remotely controlled equipment, wherein each remote control code contains the plurality of remote control commands for controlling at least one of the plurality of remotely controlled equipment.

BRIEF DESCRIPTION OF THE DRAWINGS

The above and other features of the present invention will become readily apparent by reference to the following detailed description when considered in conjunction with the accompanying drawings, wherein.

DETAILED DESCRIPTION OF PREFERRED EMBODIMENTS

Hereinafter, the present invention will be explained in detail with reference to the accompanying drawings.

Figure 1:
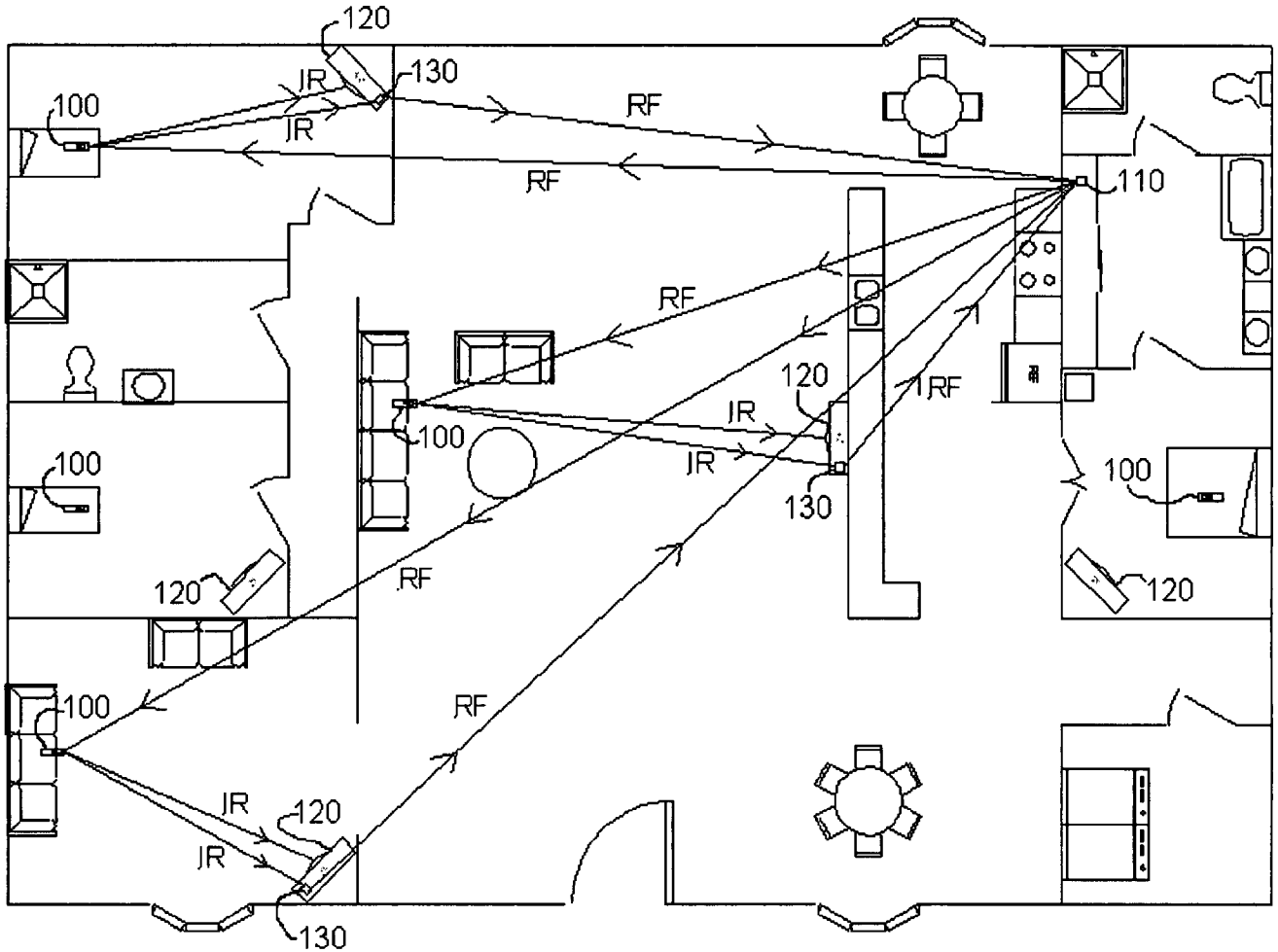
FIG. 1 is a diagram showing a remote control system according to an exemplary embodiment of the present invention.

FIG. 1 is a diagram showing a remote control system according to an exemplary embodiment of the present invention. Referring to FIG. 1, a common application for the present invention is a residence with several rooms containing several pieces of remotely controlled equipment 120 to be controlled with remote control units 100. In this embodiment there is a master controller 110 which can store the remote control codes for remotely controlled equipment 120 such as televisions, audio systems or other remotely controlled devices including garage door openers. The master controller 110 can also contain remotely controlled equipment 120 such as a satellite radio system (not shown) having controls and displays on the master controller 110. Also in this embodiment there is an optional repeater/localizer 130 that is used to relay information from the remote control units 100 to the master controller 110. In the event the master controller communicates using radio frequency (RF) signals then the repeater/localizer can receive a message transmitted using an infrared (IR) signal from the remote control units 100 and can transmit the message to the master controller 110 using an RF signal. A remote control system according to this embodiment can use several repeater/localizers positioned in different locations or rooms containing remotely controlled equipment 120.

A master controller 110 is programmed by the factory, a remote control system installer or the user to contain the remote control codes for controlling the remotely controlled equipment 120 contained in the residence. The master controller 110 can also be programmed to identify the location of the remotely controlled equipment for which it contains remote control codes.

When a user attempts to use a remote control unit 100 for the first time in a specific location, the remote control unit 100 may lack the remote control codes for the remotely controlled equipment 120 positioned in the location and assembles a request to receive the remote control codes for that location. The remote control unit 100 can also start a timer to determine if a request is processed in an appropriate amount of time. The remote control unit transmits the request for remote control codes using IR signals. In other embodiments the transmission may be by RF signals or by another communication method. The preferable IR carrier frequency for the remote control units 100 to communicate with the repeater/localizers 130 is about 455 kHz and the preferable IR carrier frequency for the remote control units 100 to communicate with the remotely controlled equipment 120 is about 38 kHz but any other suitable frequency used in home entertainment IR communication can be used. In a remote control system using multiple remote control units 100 the request for remote control codes can include an identification code for the remote control unit 100 making the request for remote control codes. The generation of an identification code can be done in a pseudo-random fashion using techniques known in the art that will not be described further. The remote control unit 100 can also generate a cyclic redundancy check (CRC) code to detect errors in the transmission. A CRC code can be generated using techniques known in the art that will not be described further.

In this embodiment of the present invention there are repeater/localizers 130 positioned in some of the locations containing remotely controlled equipment 120. The repeater/localizers can be set with a switch or programmed with a location code and can add the location code to messages received from a remote control unit 100 positioned in the same location requesting remote control codes. The repeater/localizer 130 receives the message from the remote control unit requesting remote control codes, adds the location code and transmits the request for remote control codes with the location code using an RF signal.

The master controller 110 receives the RF signal containing the request for remote control codes with the location code if included and prepares a response. In preparing a response, the master controller 110 can determine which remotely controlled equipment to send remote control codes for based on the location code. The master controller 110 can also determine if there are errors in the CRC code if included and transmit an error message. An error message can minimally contain an indication that a bad message was received so that any remote control unit 100 can operate an error function if it was waiting for remote control codes or other transmissions. If the identity of a remote control unit 100 can be determined from the received message, then the error message can contain the identity of the remote control unit 100 that sent the bad message.

The master controller 110 can transmit the requested remote control codes to the remote control units 100 using RF signals or other communication signals can be used. The transmission can include the identification code if supported by the remote control system configuration. The master controller 110 can also generate a CRC code for inclusion in the transmitted message to detect errors in the transmitted message.

The remote control unit 100 that sent the request for remote control codes can determine that the received remote control codes were intended for that remote control unit 100 by the identification code if included. The remote control unit 100 can also detect errors in the received message if the CRC included is incorrect and operate an error function. An error function can be to retransmit the request for remote control codes, to display an error message on a display such as directing the user to relocate for better reception or to sound an audible alarm.

The remote control unit 100 is self-localizing where it reports its location in messages to the master controller 110 and self-identifying where it reports which remote control unit 100 it is in messages to the master controller 110. The remote control unit 100 is also state-aware where the functions of the remote control unit 100 includes operating modes where the remote control unit 100 can receive messages from the master controller 110 including commands causing the remote control unit 100 to function via "soft" keys and its display in a way that complements the remotely controlled equipment 120 it is controlling. For example, when a remote control unit 100 is positioned in a location containing a satellite radio receiver, the remote control unit 100 can be configured through messages from the master controller 110 to operate in a satellite radio mode of operation. In the satellite radio mode of operation, the remote control unit 100 periodically requests program data to display and configures its soft keys to operate specific satellite radio functions. A remote control unit 100 requesting satellite radio program data that is not positioned in a location containing a satellite radio or in a zone control area will receive an error message to display such as "media busy."

Another mode of operation is zone control mode where a zone control unit (not shown) is positioned in a remote location so that equipment such as a satellite radio receiver positioned in another location can be operated in the remote location using remote control units 100 of the remote control system. Zone control systems typically communicate with a master controller, satellite radio or other equipment via cable and can receive signals from the remote control units 100 and convert their messages to be transmitted to the master controller, the satellite radio receiver or other equipment via the cable. In another embodiment the zone control system can also communicate with the master controller 110 in the same way as a repeater/localizer 130. The zone control system can remodulate a signal received from the remote control unit 100 and transmit the message from the remote control unit 100 to receiver equipment via the cable.

The master controller 110 can be positioned in a relatively isolated location such as in a cabinet, closet or attic if the master controller communicates using RF signals. The master controller 110 can also employ other communication signals such as IR signals in which case it can be positioned in a more prominent location for the type of communication signals it uses.

Figure 2:
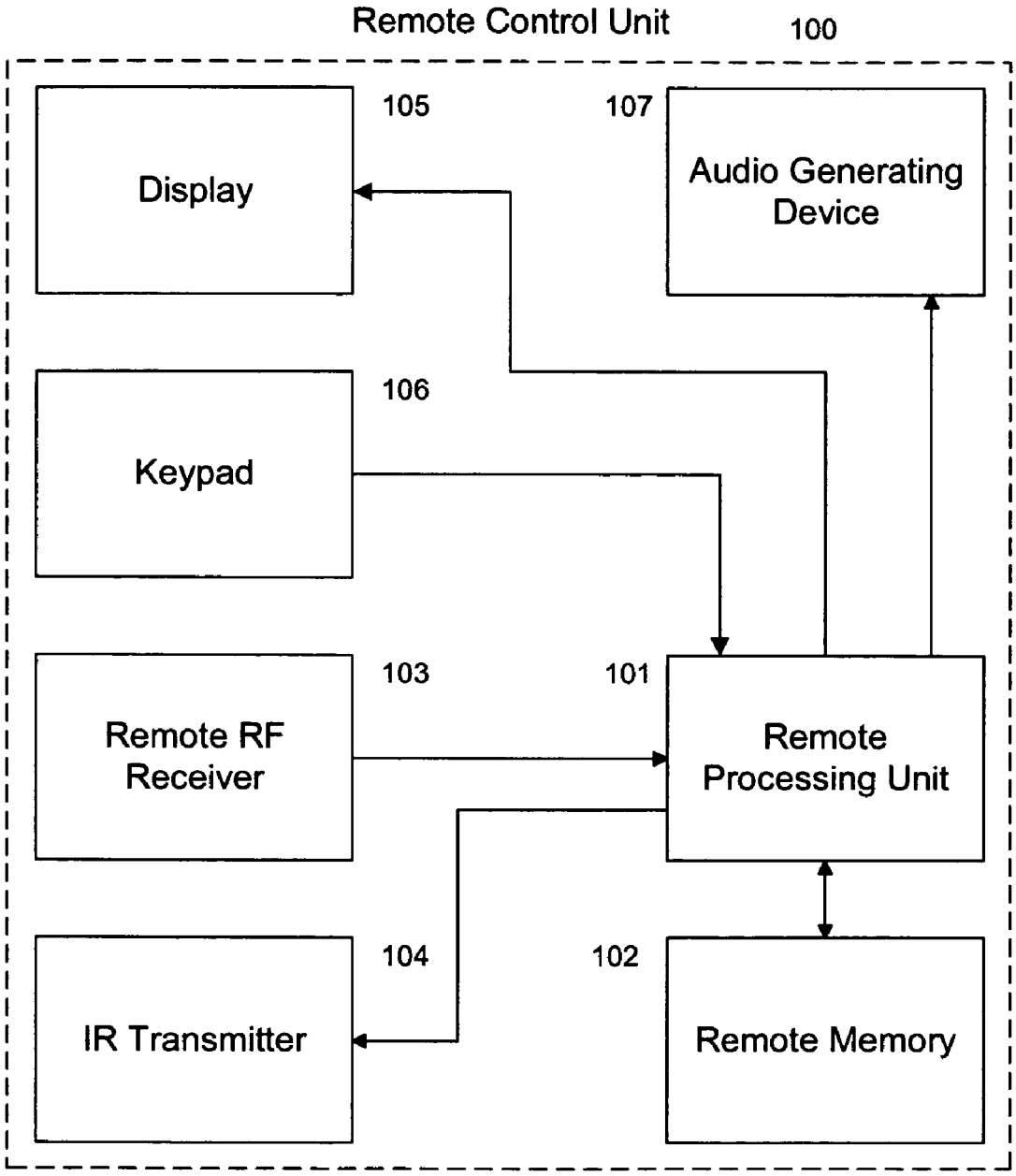
FIG. 2 is a block diagram of a remote control unit according to an exemplary embodiment of the present invention.

FIG. 2 is a block diagram of a remote control unit according to an exemplary embodiment of the present invention. Referring to FIG. 2, the remote control unit 100 of the present invention is typically a portable, handheld device. The remote control unit 100 includes a remote processing unit 101, a remote memory 102, a remote radio frequency (RF) receiver 103, an infrared (IR) transmitter 104, a display 105, a keypad 106 and an audio generating device 107. Power is typically supplied to the remote control unit 100 and its component parts by an on board battery (not shown). The battery can be of the disposable type or can be rechargeable. The remote control unit 100 can be operated while the battery is being charged by a battery charger.

The remote processing unit 101 performs the functions of the remote control unit 100 and can be a microprocessor or other electronic circuitry. The remote processing unit 101 is programmed by hardware, software or firmware to store remote control codes in the remote memory 102, to process data received from the remote RF receiver 103, to output data to the IR transmitter 104, to display messages on the display 105, to receive user inputs from the keypad 106 and to report audio information through the audio generating device 107. The remote processing unit 101 can prepare messages to be transmitted by the IR transmitter 104 and in doing so can generate a pseudorandom identifier code and error detection and correction codes such as cyclic redundancy check (CRC) codes. The remote processing unit 101 can also process messages received by the remote RF receiver 103 and in doing so decode error detection and correction codes such as CRC codes to determine the validity of messages received. The remote processing unit 101 can operate and monitoring a timer to determine if a sent message has been responded to in a predetermined amount of time so that an error function can be operated. The remote processing unit 101 can be used for other remote control unit 100 processing functions contemplated by the present invention that can be implemented in the same manner.

The remote memory 102 is in communication with and electrically connected with the remote processing unit 101. The remote memory 102 is typically a semiconductor memory device but can be any other type of electronic storage circuitry. The remote memory 102 is used to store remote control codes and other remote control operation data including software to operate the remote processing unit 101.

The remote RF receiver 103 is in communication with and electrically connected with the remote processing unit 101. The remote RF receiver 103 is a conventional circuit including an antenna that is known in the art and will not be described further. The remote processing unit 101 processes messages received by the remote RF receiver 103. The remote processing unit 101 also controls when the remote RF receiver 103 is active to save power. The remote RF receiver 103 does not need to be powered when the remote processing unit 101 is not expecting to receive messages. The remote RF receiver 103 may be intermittently activated by the remote processing unit 101 to search for messages. The remote RF receiver 103 can receive remote control codes from the master controller 110 or other such messages as requests for the remote control unit 100 to identify its location. Other types of messages are contemplated by the present invention that can be implemented in the same manner.

The IR transmitter 104 is in communication with and electrically connected with the remote processing unit 101. The IR transmitter 104 can transmit on more than one carrier frequency. The preferable IR carrier frequency for the remote control units 100 to communicate with the repeater/localizers 130 is about 455 kHz and the preferable IR carrier frequency for the remote control units 100 to communicate with the remotely controlled equipment 120 is about 38 kHz but any other suitable frequency used in home entertainment IR communication can be used. The IR transmitter 104 is a conventional circuit including IR signal generators that are known in the art and will not be described further. The IR transmitter 104 transmits messages prepared by the processing unit 101. The remote processing unit 101 also controls when the IR transmitter 104 is active to save power. The IR transmitter 104 does not need to be powered when it is not transmitting messages. The messages transmitted by the IR transmitter 104 can be remote control codes sent to remotely controlled equipment 120 or can be requests to the repeater/localizers 130 to receive remote control codes from the master controller 110. Other types of messages are contemplated by the present invention that can be implemented in the same manner.

The display 105 is in communication with and electrically connected with the remote processing unit 101. The display 105 can be an electronic display device such as a liquid crystal display device, light emitting diode array or other form of visual indicator device including incandescent devices. The remote processing unit 101 utilizes the display 105 to present relevant information to the user. This information includes but is not limited to program information regarding the remotely controlled equipment 120 that the remote control unit is in proximity with, location identification alerts and information to indicate the function of the remote control unit 100 such as programmable keypad buttons or "soft" keys. Currently, typical satellite radio systems transmit program data and require the display of this data in order for a product to be certified for use with their system. The remote control unit 100 can display this program data on the display 105.

The keypad 106 is in communication with and electrically connected with the remote processing unit 101. The keypad 106 is typically a conventional array of switches mounted on the surface of the remote control unit 100 to receive user input. The information input to the keypad 106 by the user is communicated to the remote processing unit 101 where it is processed to determine the nature and intent of the user's commands. The functions of some of the keypad switches can be altered by the remote processing unit 101 to create remote control system programmable keypad buttons or "soft" keys. The user input can initiate a process where the remote processing unit 101 identifies the location of the remote control unit 100, requests remote control codes or it can cause the transmission of remote control codes to the remotely controlled equipment 120 for command purposes. Other user inputs are contemplated by the present invention that can be implemented in the same manner.

The audio generating device 107 is in communication with and electrically connected with the remote processing unit 101. The audio generating device 107 can be a conventional tone generator device or other electronic audio generation device. The audio generating device 107 is used to report audio signals to the user to alert the user of conditions requiring user response including but not limited to the remote control unit 100 location, program response requirements, timed response reminders and other audio alert functions contemplated by the present invention that can be implemented in the same manner.

In another embodiment of the present invention, the remote control unit 100 can include an RF transmitter and communicate directly with the master controller 110.

Figure 3:
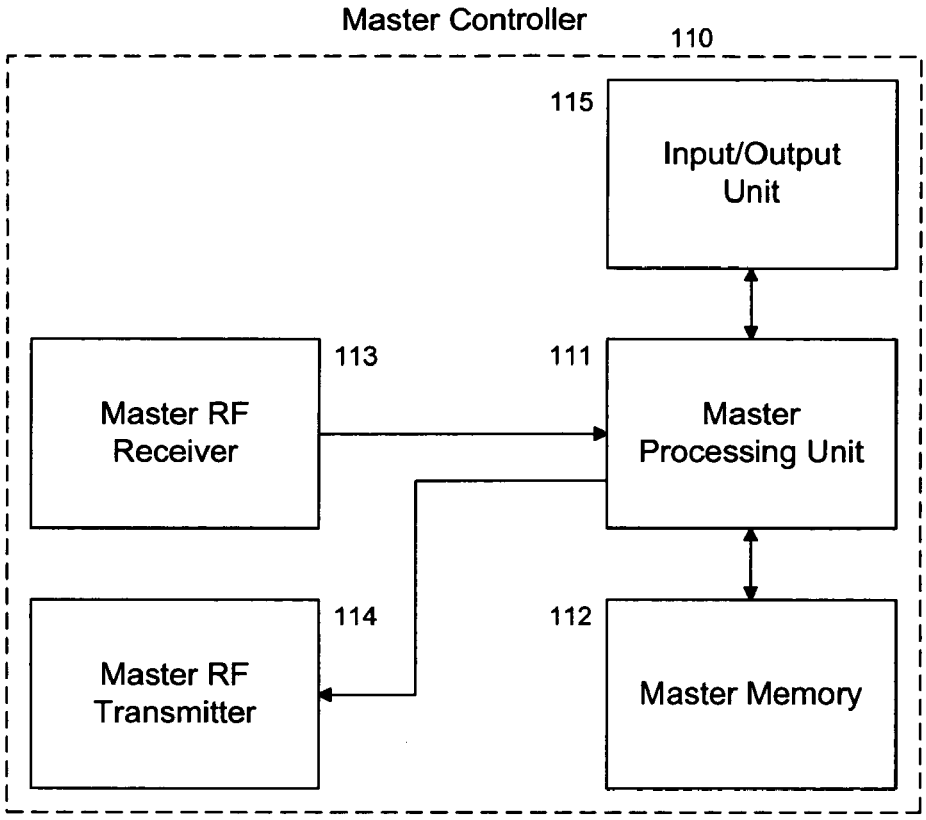
FIG. 3 is a block diagram of a master controller according to an exemplary embodiment of the present invention.

FIG. 3 is a block diagram of a master controller according to an exemplary embodiment of the present invention. Referring to FIG. 3, the master controller 110 is typically a standalone device that can be positioned for use in a concealed location such as a cabinet, closet or attic. The master controller 110 can communicate with the other devices of the remote control system using radio frequency (RF) signals that are capable of transmission through barriers of typical residential construction. The master controller 110 includes a master processing unit 111, a master memory 112, a master radio frequency (RF) receiver 113, a master RF transmitter 114 and an input/output unit 115. Power is supplied to the master controller 110 and its component parts by either a conventional on-board line current power supply unit (not shown), a conventional external power pack unit (not shown) or by an on-board battery (not shown). The battery can be of the disposable type or can be rechargeable. The master controller 110 can be operated while the battery is being charged by a battery charger.

The master processing unit 111 performs the functions of the master controller 110 and can be a microprocessor or other electronic circuitry. The master processing unit 111 is programmed by hardware, software or firmware to store remote control codes in the master memory 112, to process data received from the master RF receiver 113, to output data to the master RF transmitter 114, to receive user inputs from and to output user information to the input/output unit 115. The master processing unit 111 can prepare messages to be transmitted by the master RF transmitter 113 and in doing so can generate error detection and correction codes such as cyclic redundancy check (CRC) codes. The master processing unit 111 can also process messages received by the master RF receiver 114 and in doing so decode error detection and correction codes such as CRC codes to determine the validity of messages received. The master processing unit 111 can be used for other master controller unit 111 processing functions contemplated by the present invention that can be implemented in the same manner.

The master memory 112 is in communication with and electrically connected with the master processing unit 111. The master memory 112 is typically a semiconductor memory device but can be any other type of electronic storage circuitry. The master memory 112 is used to store remote control codes and other remote control operation data including software to operate the master processing unit 111.

The master RF receiver 113 is in communication with and electrically connected with the master processing unit 111. The master RF receiver 113 is a conventional circuit including an antenna that is known in the art and will not be described further. The master processing unit 111 processes messages received by the master RF receiver 113. The master processing unit 111 also controls when the master RF receiver 113 is active to save power. The master RF receiver 113 does not need to be powered when the master processing unit 111 is not expecting to receive messages. The master RF receiver 113 may be intermittently activated by the master processing unit 111 to search for messages. The master RF receiver 113 can receive remote control code requests from repeater/localizers 130 that originated from a remote control unit 100. The master RF receiver 113 can also receive requests to locate remote control units 100 from repeater/localizers 130. Other types of messages are contemplated by the present invention that can be implemented in the same manner.

The master RF transmitter 114 is in communication with and electrically connected with the master processing unit 111. The master RF transmitter 114 is a conventional circuit including an antenna that is known in the art and will not be described further. The master RF transmitter 114 transmits messages prepared by the master processing unit 111. The messages transmitted by the master RF transmitter 114 can be remote control codes sent to remote control units 100 or can be signals to remote control units 100 to identify their locations. Other types of messages are contemplated by the present invention that can be implemented in the same manner.

The input/output unit 115 is in communication with and electrically connected with the master processing unit 111. The input/output unit 115 is typically a conventional array of switches and optionally a visual display or an electronic data connection such as a computer interface connection. The input/output unit 115 allows the user or a technician to load the master controller 110 with data such as remote control codes, software updates or other master controller 110 required data. The input/output unit 115 can also allow the user or technician to receive data and other status information regarding the remote control system from the master controller 110. Other types of input and output communications are contemplated by the present invention that can be implemented in the same manner.

In another exemplary embodiment of the present invention the master controller 110 is combined in the same physical unit (not shown) with remotely controlled equipment such as a satellite radio system (not shown) having conventional controls (not shown) and displays (not shown) on the unit, wherein the master controller and the remotely controlled equipment will communicate directly using conventional electronic connections. Currently, typical satellite radio systems transmit program data and require the display of this data in order for a product to be certified for use with their system. The master controller 110 can display this program data on the conventional display on the master controller 110. In this embodiment the master controller 110 can receive remote control commands from and send messages to a dedicated remote control unit or a remote control unit 100 that is part of the remote control system.

Figure 4:
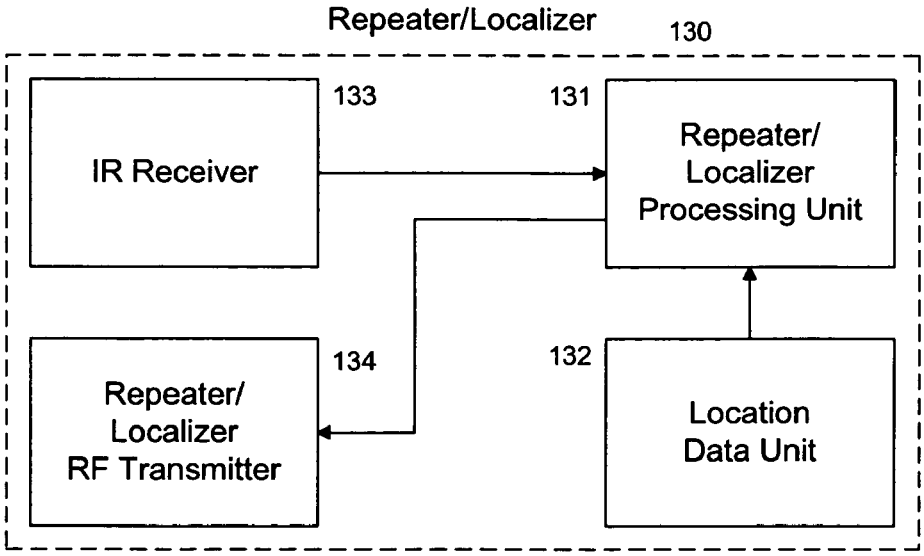
FIG. 4 is a block diagram of a repeater/localizer according to an exemplary embodiment of the present invention.

FIG. 4 is a block diagram of a repeater/localizer according to an exemplary embodiment of the present invention. Referring to FIG. 4, the repeater/localizer 130 is typically a stand alone device that can be positioned in a room where remotely controlled equipment 120 is located. The repeater/localizer 130 includes a repeater/localizer processing unit 131, a location data unit 132, an IR receiver 133 and a repeater/localizer RF transmitter 134. Power is typically supplied to the repeater/localizer 130 and its component parts by either a conventional on-board line current power supply unit (not shown), a conventional external power pack unit (not shown) or by an on-board battery (not shown). The battery can be of the disposable type or can be rechargeable. The repeater/localizer 130 can be operated while the battery is being charged by a battery charger.

The repeater/localizers 130 can have a button that activates a search for any remote control units positioned in the location of the repeater/localizer 130. A message is sent from the requesting repeater/localizer 130 to the master controller 110. The master controller 110 then sends a message to any remote control unit 100 with a location code that is the same as the repeater/localizer 130 to identify itself by sounding an alert and producing a visual indication on its display. Alternatively, the master controller 110 can have a button to send messages to all of the remote control units 100 where all of the remote control units 100 will identify their positions in the same manner, optionally with varying alerts for each remote control unit 100.

The repeater/localizer processing unit 131 performs the functions of the repeater/localizer 130 and can be a microprocessor or other electronic circuitry and can contain its own memory. The repeater/localizer processing unit 131 is programmed by hardware, software or firmware to store and process information received from the location data unit 132, to process data received from the IR receiver 133 and to output data to the repeater/localizer RF transmitter 114. The repeater/localizer processing unit 131 can process messages received by the IR receiver 133 and in doing so decode error detection and correction codes such as CRC codes to determine the validity of messages received. The repeater/localizer processing unit 131 can also prepare messages to be transmitted by the repeater/localizer RF transmitter 134 and in doing so can generate location codes and error detection and correction codes such as cyclic redundancy check (CRC) codes to be included in the messages. The repeater/localizer processing unit 131 can also transmit a request to the master controller 110 for the master controller 110 to send commands to the remote control units 100 to identify their locations. The repeater/localizer processing unit 131 can be used for other repeater/localizer 130 processing functions contemplated by the present invention that can be implemented in the same manner.

The location data unit 132 is in communication with and electrically connected with the repeater/localizer processing unit 131. The location data unit 132 is typically a conventional single switch or array of switches or an electronic data connection such as a computer interface connection. The location data unit 132 allows the user or a technician to set or input the room location of the repeater/localizer 130 to allow the location data unit 132 to supply location information to the master controller 110 during remote control requests from the remote control units 100 positioned in the room location that the repeater/localizer 130 is in. The location data unit 132 can also allow the user to initiate a request for the remote control units 100 to identify their locations. Other location data unit 132 input functions are contemplated by the present invention that can be implemented in the same manner.

The IR receiver 133 is in communication with and electrically connected with the repeater/localizer processing unit 131. The IR receiver 133 is a conventional circuit that is known in the art and will not be described further. The repeater/localizer processing unit 131 processes messages received by the IR receiver 133. The repeater/localizer processing unit 131 also controls when the IR receiver 133 is active to save power. The IR receiver 133 does not need to be powered when the repeater/localizer processing unit 131 is not expecting to receive messages. The IR receiver 133 may be intermittently activated by the repeater/localizer processing unit 131 to search for messages. The IR receiver 133 can receive remote control code requests from remote control units 100. Other types of messages are contemplated by the present invention that can be implemented in the same manner.

The repeater/localizer RF transmitter 134 is in communication with and electrically connected with the repeater/localizer processing unit 131. The repeater/localizer RF transmitter 134 is a conventional circuit including an antenna that is known in the art and will not be described further. The repeater/localizer RF transmitter 134 transmits messages prepared by the repeater/localizer processing unit 131. The messages transmitted by the repeater/localizer RF transmitter 134 can be remote control code requests received from remote control units 100. Other types of messages are contemplated by the present invention that can be implemented in the same manner.

The IR signals used by the IR receiver 133 are preferably about 455 kHz but the frequency can be about 38 kHz or any other suitable frequency used in home entertainment IR communication.

Figure 5:
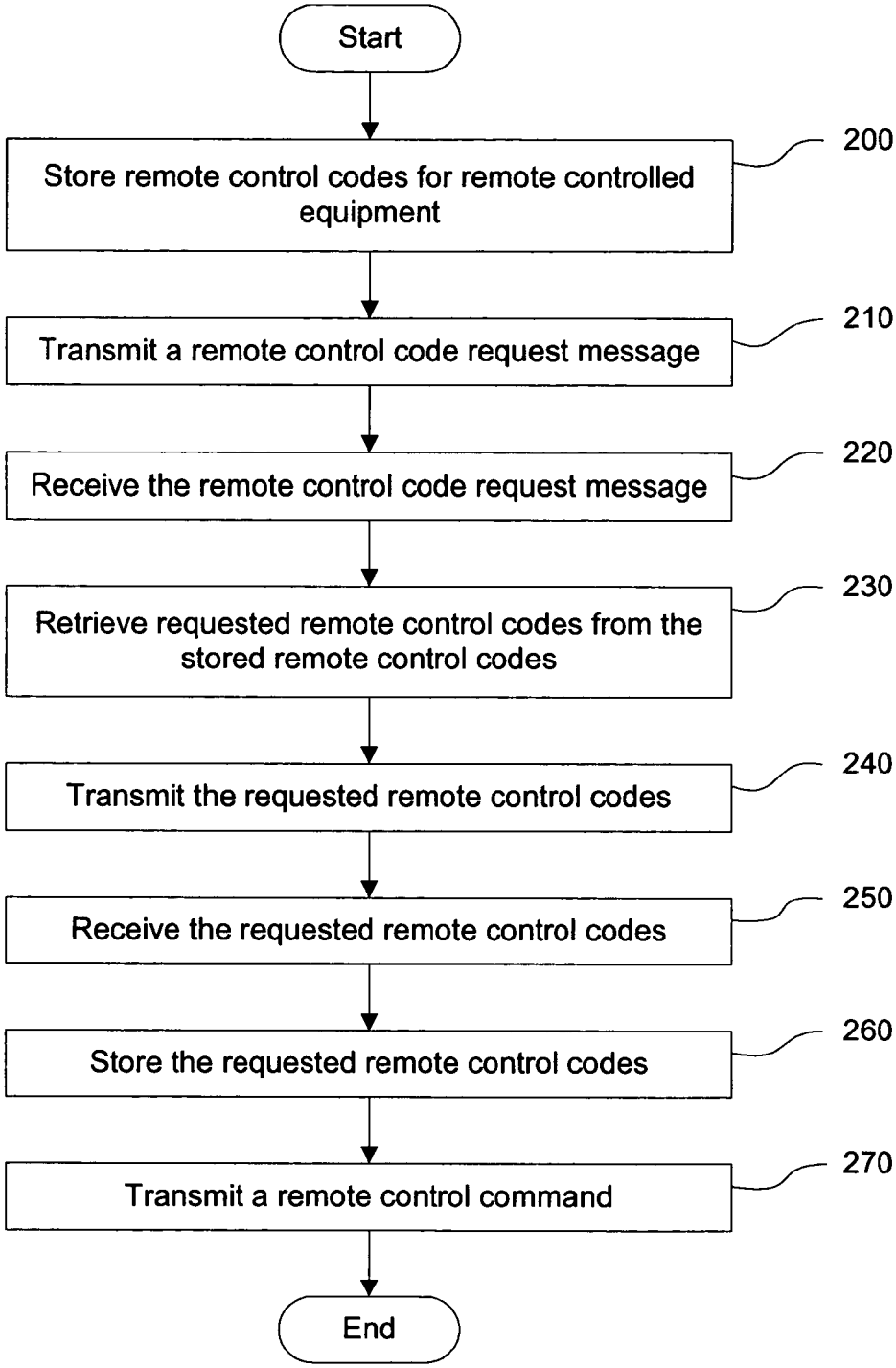
FIG. 5 is a flow diagram showing a method of operating a remote control system according to an exemplary embodiment of the present invention.

FIG. 5 is a flow diagram showing a method of operating a remote control system according to another exemplary embodiment of the present invention. The manufacturer or installer of a remote control system of the present invention stores remote control codes for remotely controlled equipment 200 in a master controller.

In one exemplary embodiment of the remote control system, the master controller can contain the remote control codes for all known remotely controlled equipment and the master controller can have the capability to have remote control codes for additional remotely controlled equipment stored as the remotely controlled equipment becomes available or as the user adds the remotely controlled equipment to the remote control system.

When a user attempts to use a remote control unit, the remote control unit assembles and transmits a remote control code request message 210. The master controller receives the remote control code request message 220 and retrieves the requested remote control codes from the stored remote control codes 230 contained in the master controller. The master controller then transmits the requested remote control codes 240 back to the remote control unit. The remote control unit receives the requested remote control codes 250 and stores the requested remote control codes 260 for later use to transmit a remote control command 270 to remotely controlled equipment the user intends to operate.

In another exemplary embodiment, the remote control code request message can be intercepted by a repeater/localizer positioned in the same location as the remote control unit and a location code is appended to the message before retransmission to the master controller. In the case where there is a repeater/localizer utilized, the remote can transmit using IR signals received by the repeater/localizer and then transmitted by the repeater/localizer using RF signals. Then the master controller receives the remote control code request message with the location code, retrieves the requested remote control codes based on the remotely controlled equipment positioned in the location specified by the location code and transmits the requested remote control codes back to the remote control unit making the request. In the case where there is a repeater/localizer, messages to the remote control unit can be sent using RF signals. Where infrared signals are used, about 455 kHz is the preferable IR carrier frequency for communication from the remote control units to the repeater/localizers and about 38 kHz is the preferable IR carrier frequency for communication from the remote control units to the remotely controlled equipment but any other suitable frequency used in home entertainment IR communication can be used.

In another exemplary embodiment the transmission of a remote control code request message can include appending a cyclic redundancy check (CRC) code to messages and checking for correct CRC codes with error messages transmitted for incorrect CRC codes. A timer can operate to determine if messages have not been responded to in a predetermined time interval and operate an error function.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A remote control system, comprising:

a master controller for storing a plurality of remote control codes for a plurality of remotely controlled equipment in a plurality of locations, receiving a remote control code request message, retrieving a requested remote control code and transmitting the requested remote control code;

a repeater/localizer for receiving the remote control code request message, adding a location code to the remote control code request message and transmitting the remote control code request message with the added location code, wherein the master controller retrieves the requested remote control code based on the location code, and wherein the repeater/localizer transmits a location search request to the master controller, the master controller transmits a location identification request to one or more remote control units having a location code that matches the location code of the repeater/localizer upon receiving the location search request, and the one or more remote control units indicate a current location upon receiving the location identification request; and a remote control unit for transmitting the remote control code request message, receiving the requested remote control code from the master controller, storing the requested remote control code, converting the remote control code into a plurality of remote control commands and transmitting at least one of the plurality of remote control commands to at least one of the plurality of remotely controlled equipment, wherein each remote control code contains the plurality of remote control commands for controlling at least one of the plurality of remotely controlled equipment, and wherein the requested remote control code is transmitted directly from the master controller to the remote control unit.

2. The remote control system of claim 1, wherein the master controller is combined with a satellite radio receiver and display unit, a home theater receiver and display unit, or other remotely controlled equipment.

3. The remote control system of claim 1, wherein there are multiple remote control units, with each remote control unit generating an identifier code to include with the remote control code request message and the master controller transmitting the requested remote control code message with the identifier code.

4. The remote control system of claim 3, wherein the identifier code is generated using a pseudorandom number.

5. The remote control system of claim 1, wherein the remote control unit or the master controller generate a cyclic redundancy check (CRC) to include with transmitted messages, and the remote control unit or the master controller analyzes received messages for correct CRC and transmits an error message if the CRC is incorrect.

6. The remote control system of claim 5, wherein the remote control unit or the master controller detects CRC error messages and operates an error function.

7. The remote control system of claim 6, wherein the error function operated by the remote control unit includes retransmitting the remote control code request message, displaying an error message on a graphical display or sounding an audible warning on an audio transmitter and the error function operated by the master controller includes transmitting an error message.

8. The remote control system of claim 1, wherein the remote control unit operates a timer to determine if the remote control code request message has been processed by the master controller and operates an error function after a predetermined time interval, and the error function operated by the remote control unit includes retransmitting the remote control code request message, displaying an error message on a graphical display or sounding an audible warning on an audio transmitter.

9. The remote control system of claim 1, wherein the remote control unit displays program information received from the master controller on a graphical display or sounds an audible warning on an audio transmitter.

10. The remote control system of claim 1, wherein the remote control unit receives and transmits using infrared (IR) or radio frequency (RF) signals and the master controller receives and transmits using IR or RF signals.

11. The remote control system of claim 10, wherein the IR signal uses about a 38 kHz or about a 455 kHz carrier frequency.

12. The remote control system of claim 1, wherein the remote control unit receives using radio frequency (RF) signals and transmits using infrared (IR) or RF signals, the repeater/localizer receives using IR or RF signals and transmits using RF signals, and the master controller receives and transmits using RF signals.

13. A method of operating a remote control system, comprising:

storing in a master controller a plurality of remote control codes for a plurality of remotely controlled equipment in a plurality of locations;

transmitting from a remote control unit a remote control code request message;

receiving the remote control code request message;

retrieving in the master controller the requested remote control code;

transmitting from the master controller the requested remote control code;

receiving in the remote control unit the requested remote control code;

converting in the remote control unit the requested remote control code into a plurality of remote control commands for controlling at least one of the plurality of remotely controlled equipment;

storing in the remote control unit the plurality of remote control commands;

transmitting at least one of the plurality of remote control commands to control at least one of the plurality of remotely controlled equipment, wherein each remote control code contains the plurality of remote control commands for controlling at least one of the plurality of remotely controlled equipment, and wherein the requested remote control code is transmitted directly from the master controller to the remote control unit;

transmitting a location search request from a repeater/localizer to the master controller; and transmitting a location identification request from the master controller to one or more remote control units having a location code that matches a location code of the repeater/localizer, upon receiving the location search request, wherein the one or more remote control units indicate a current location upon receiving the location identification request.

14. The method of operating a remote control system of claim 13, wherein the step of storing in a master controller a plurality of remote control codes for a plurality of remotely controlled equipment includes storing in a master controller a plurality of remote control codes for a plurality of remotely controlled equipment and at least one location code corresponding to a location of at least one of the plurality of remotely controlled equipment, the step of receiving the remote control code request message includes receiving in the repeater/localizer the remote control code request message, transmitting from the repeater/localizer the remote control code request message with a location code corresponding to a location of the repeater/localizer, and receiving in the master controller the requested remote control code message with the location code corresponding to a location of the repeater/localizer, and the step of retrieving in the master controller the requested remote control code includes retrieving in the master controller the requested remote control code based on the location code corresponding to a location of the repeater/localizer, wherein the location code corresponding to a location of the repeater/localizer is set to the same location code corresponding to a location of at least one of the plurality of remotely controlled equipment.

15. The method of operating a remote control system of claim 13, wherein the step of transmitting from a remote control unit a remote control code request message includes transmitting from a remote control unit a remote control code request message with a remote control unit identifier code, and the step of transmitting from the master controller the requested remote control code includes transmitting from the master controller the requested remote control code with the remote control unit identifier code.

16. The method of operating a remote control system of claim 13, wherein the step of transmitting from a remote control unit a remote control code request message includes transmitting from a remote control unit a remote control code request message with a cyclic redundancy check (CRC), and the step of receiving in the remote control unit the remote control code request message includes receiving in the remote control unit the remote control code request message with the CRC, analyzing in the remote control unit the remote control code request message for correct CRC and transmitting from the remote control unit an error message if the CRC is incorrect.

17. The method of operating a remote control system of claim 13, wherein the step of transmitting from a remote control unit a remote control code request message includes transmitting from a remote control unit a remote control code request message, operating in the remote control unit a timer to determine if the remote control code request message has been processed and operating in the remote control unit an error function after a predetermined time interval.

18. The method of operating a remote control system of claim 17, wherein the step of operating in the remote control unit an error function includes retransmitting from the remote control unit the remote control code request message, displaying on the remote control unit an error message on a graphical display or sounding from the remote control unit an audible warning.

19. The method of operating a remote control system of claim 13, wherein the step of transmitting from a remote control unit a remote control code request message includes transmitting from a remote control unit a remote control code request message using infrared (IR) or radio frequency (RF) signals, the step of transmitting from the master controller the requested remote control code includes transmitting from the master controller the requested remote control code using IR signals, and the step of transmitting from a remote control unit a remote control command includes transmitting from a remote control unit a remote control command using IR signals.

20. The method of operating a remote control system of claim 19, wherein the IR signal uses about a 38 kHz or about a 455 kHz carrier frequency.

21. The method of operating a remote control system of claim 14, wherein the step of transmitting from a remote control unit a remote control code request message includes transmitting from a remote control unit a remote control code request message using infrared (IR) or radio frequency (RF) signals, the step of transmitting from the repeater/localizer the remote control code request message with a location code corresponding to a location of the repeater/localizer includes transmitting from the repeater/localizer the remote control code request message with a location code corresponding to a location of the repeater/localizer using RF signals, and the step of transmitting from the master controller the requested remote control code includes transmitting from the master controller the requested remote control code using RF signals.

22. The method of operating a remote control system of claim 21, wherein the IR signal uses about a 38 kHz or about a 455 kHz carrier frequency.

23. The remote control system of claim 1, wherein the repeater/localizer comprises a button configured to activate the location search request, and the one or more remote control units each comprise an audio transmitter to audibly indicate the current location and a graphical display to visually indicate the current location.

24. The remote control system of claim 1, wherein the remote control unit comprises a graphical display for displaying one or more soft keys configured to perform one or more operations, wherein the one or more operations vary according to remotely controlled equipment currently controlled by the remote control unit.

* * * * *